US007594798B1

(12) United States Patent
Bucher et al.

(10) Patent No.: US 7,594,798 B1
(45) Date of Patent: Sep. 29, 2009

(54) OUTDOOR HIGH VELOCITY WALL AND FLOOR FANS

(75) Inventors: John C. Bucher, Hillsboro Beach, FL (US); William Carter, Canton, GA (US); Chad Ricker, North Lauderdale, FL (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 446 days.

(21) Appl. No.: 11/510,154

(22) Filed: Aug. 25, 2006

Related U.S. Application Data

(63) Continuation-in-part of application No. 29/261,391, filed on Jun. 13, 2006.

(60) Provisional application No. 60/834,520, filed on Jul. 31, 2006.

(51) Int. Cl.
*F04D 29/26* (2006.01)

(52) U.S. Cl. ..... 416/100; 416/244 R; 416/247 R; 415/129; 415/121.2; 417/234

(58) Field of Classification Search ..... 416/100, 416/210 R, 244, 63; 417/234; 310/88; 248/207, 248/214, 231.91, 317, 344, 343; 415/121.2, 415/129
See application file for complete search history.

(56) References Cited

U.S. PATENT DOCUMENTS

| | | | | |
|---|---|---|---|---|
| D307,320 | S | 4/1990 | Shin-Chin | D23/382 |
| D323,885 | S | 2/1992 | Wortham | D23/378 |
| 5,265,895 | A | 11/1993 | Barrett | 280/47.24 |
| D384,738 | S | 10/1997 | Jane et al. | D23/378 |
| D416,617 | S | 11/1999 | Jane et al. | D23/378 |
| D426,296 | S | 6/2000 | Blateri | D23/382 |
| D426,631 | S | 6/2000 | Thakur | D23/378 |
| D444,552 | S | 7/2001 | Wang | D23/382 |
| D480,466 | S | 10/2003 | Bucher et al. | D23/382 |

*Primary Examiner*—Ninh H Nguyen
(74) *Attorney, Agent, or Firm*—Brian S. Steinberger; Law Offices of Brian S. Steinberger, P.A.

(57) ABSTRACT

Outdoor high velocity wall and pedestal mounted fans, devices, apparatus, systems and methods of operation. The fans can have water resistant motor housings with at most one rear wall located opening for allowing a power cord to pass therethrough. The switches and pull chains are connected to the fan only through the bottom of the motor housing. The bottom of the motor housing can have a drainage hole for allowing excess moisture to drain therefrom. The motor housing can be stainless steel. Additionally, the motor housing can have a powder coat finish on all parts to reduce corrosion. The motor can be an oversized inverted outdoor rated oscillating motor having improved gear mechanisms for big torques and reduces heat rise during fan operation. The fan can operate under hot and cold temperature extremes as well as during wet and dry environmental conditions.

17 Claims, 16 Drawing Sheets

OUTDOOR HIGH VELOCITY WALL AND FLOOR FANS

This invention is a Continuation-In-Part of U.S. Patent Application 29/261,391 filed Jun. 13, 2006, and this invention claims the benefit of priority to U.S. Provisional Patent Application Ser. No. 60/834,520 filed Jul. 31, 2006.

FIELD OF INVENTION

This invention relates to fans, in particular to high velocity wall and floor fans for outdoor use, and related devices, systems and methods of operation.

BACKGROUND AND PRIOR ART

Electrical fans have been in use for many years. There have been many designs in the field for 100 years on industrial, pedestal and wall fans. Traditional types of electrical fans that run off 120 volt power supplies have included pedestal based fans and mounted fans, where the motors are mounted adjacent to and generally behind the fan rotors. These traditional fans are well known for indoor use.

However, the traditional wall plug useable fans have housings with openings therethrough that do not allow for outdoor use. For example, traditional fans have open vents for allowing airflow therethrough to keep the motors cool. The traditional fan motors can easily overheat since the tendency is run undersized motors to reduce electricity demand, where the heating motors must be continuously vented to eliminate overheating effects that would result in damage to the fans, such as burn-out and potentially fires.

Traditional fans often use on/off type switches, such as oscillation switches, on the top of the housings and/or rotary switches having space around the switches which would attract gravity traveling moisture such as that from rainfall and dew effects into the fan housing and the electrical components therein.

Similarly, traditional fans have used pull chains located in the side of motor housings or in the top of the motor housings which also attract gravity traveling moisture such as that from rainfall and dew effects into the fan housing and the electrical components therein.

Thus these fans cannot be used outdoors or in wet damp environments since the motor housings allow for moisture to enter through vents, and openings in the housings. Thus, traditional wall and pedestal mounted fans are not useful in outdoor settings such as in backyards, around pools, in gazebos, and the like.

Still furthermore, traditional fans will have closed bottoms in their motor housings which will tend to allow for moisture to accumulate inside and potentially damage the motor and electrical components inside the housing.

Additionally, the traditional fans have included metal housings and parts that tend to rust and deteriorate over time and cannot be used in outdoor and wet environments. Traditional service coatings on the housings do not prevent rust and corrosion damage. Additionally, the vented side openings allow for the internal metal components to also rust and corrode over time and create a short lifespan for the fans.

Alternatively, many traditional electrical fans use materials such as plastic with or without metal for their exterior, where the plastic is not durable and eventually crumbles and fails under continuous exposure to outdoor exposure.

In addition, traditional fans often are recommended to only be operated under mild conditions such as that found in continuously air conditioned environments. Hot and cold temperatures and continuous temperature changes will also cause traditional fans to eventually fail by exposure to the outdoor variable conditions.

Thus, the need exists for solutions to the above problems with the prior art.

SUMMARY OF THE INVENTION

A primary objective of the present invention is to provide high velocity wall and floor fans, devices, systems and methods of operation for outdoor use.

A secondary objective of the present invention is to provide high velocity wall and floor fans, devices, systems and methods of operation for outdoor use, being sealed on the top and around switch openings and wire openings in the motor housing.

A third objective of the present invention is to provide high velocity wall and floor fans, devices, systems and methods of operation for outdoor use, having completely sealed motor housings except for small-narrow hole on the top back end shield that lets the wires into the housing.

A fourth objective of the present invention is to provide high velocity wall and floor fans, devices, systems and methods of operation for outdoor use, having small drainage hole (s) only on the bottom of the motor housing to allow for any moisture to safely drain away from the motor housing.

A fifth objective of the present invention is to provide high velocity wall and floor fans, devices, systems and methods of operation for outdoor use, having on/off switches such as an oscillation control switch only on the bottom of the motor housing that also inhibits gravity traveling moisture from entering into the motor housing.

A sixth objective of the present invention is to provide high velocity wall and floor fans, devices, systems and methods of operation for outdoor use, having pull chains only on the bottom of the motor housing that also inhibits gravity traveling moisture from entering into the motor housing.

A seventh objective of the present invention is to provide high velocity wall and floor fans, devices, systems and methods of operation for outdoor use, that allows for long life protection from exposure to outdoor elements but also is tough enough to give good fan performance at different temperatures.

An eighth objective of the present invention is to provide high velocity wall and floor fans, devices, systems and methods of operation for outdoor use, that can use oversized motors to reduce heat rise.

A ninth objective of the present invention is to provide high velocity wall and floor fans, devices, systems and methods of operation for outdoor use, having an inverted outdoor rated oscillating motor.

A tenth objective of the present invention is to provide high velocity wall and floor fans, devices, systems and methods of operation for outdoor use, with an improved gear mechanism to give long life operation at big torques on the gear.

A eleventh objective of the present invention is to provide high velocity wall and floor fans, devices, systems and methods of operation for outdoor use, having components made out of stainless steel for durability and extended lifespan.

A twelfth objective of the present invention is to provide high velocity wall and floor fans, devices, systems and methods of operation for outdoor use, having a powder coat finish on all parts to reduce corrosion.

An thirteenth objective of the present invention is to provide high velocity wall and floor fans, devices, systems and methods of operation for outdoor use, that can effectively and continuously operate under different temperature conditions such as hot, cold, and variable conditions therebetween.

A fourteenth objective of the present invention is to provide high velocity wall and floor fans, devices, systems and methods of operation for outdoor use, that can effectively and continuously operate under extreme weather conditions such as during snow, icing conditions, humid conditions, dry conditions, and windy conditions such as that found during hurricanes, and the like.

A preferred embodiment of a high velocity fan for outdoor use, can include a plurality of blades, an electric motor supplied by electric power, for rotating the blades, and a waterproof housing about the motor for preventing moisture infiltration to the motor therein, the housing being waterproof with no exterior vents through the housing.

The motor housing can have a small opening in a rear wall of the housing for allowing an electrical power wire to sealingly pass therethrough.

The housing can further have at least one drainage opening underneath the front and/or the rear surface of the housing.

The housing can further have a power activation switch such as but not limited to a pull chain for the fan, and a mount for mounting the control switch underneath the housing.

The housing can further have an oscillating knob mounted underneath the housing, and gear linkage can be placed underneath the housing.

There are no openings into the housing along the top of the housing.

The housing and other components can be made from stainless steel. The housing can include and/or further have a powder coat finish thereon.

The invention can operate with an oversized motor such as but not limited to an inverted outdoor rated oscillating motor.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
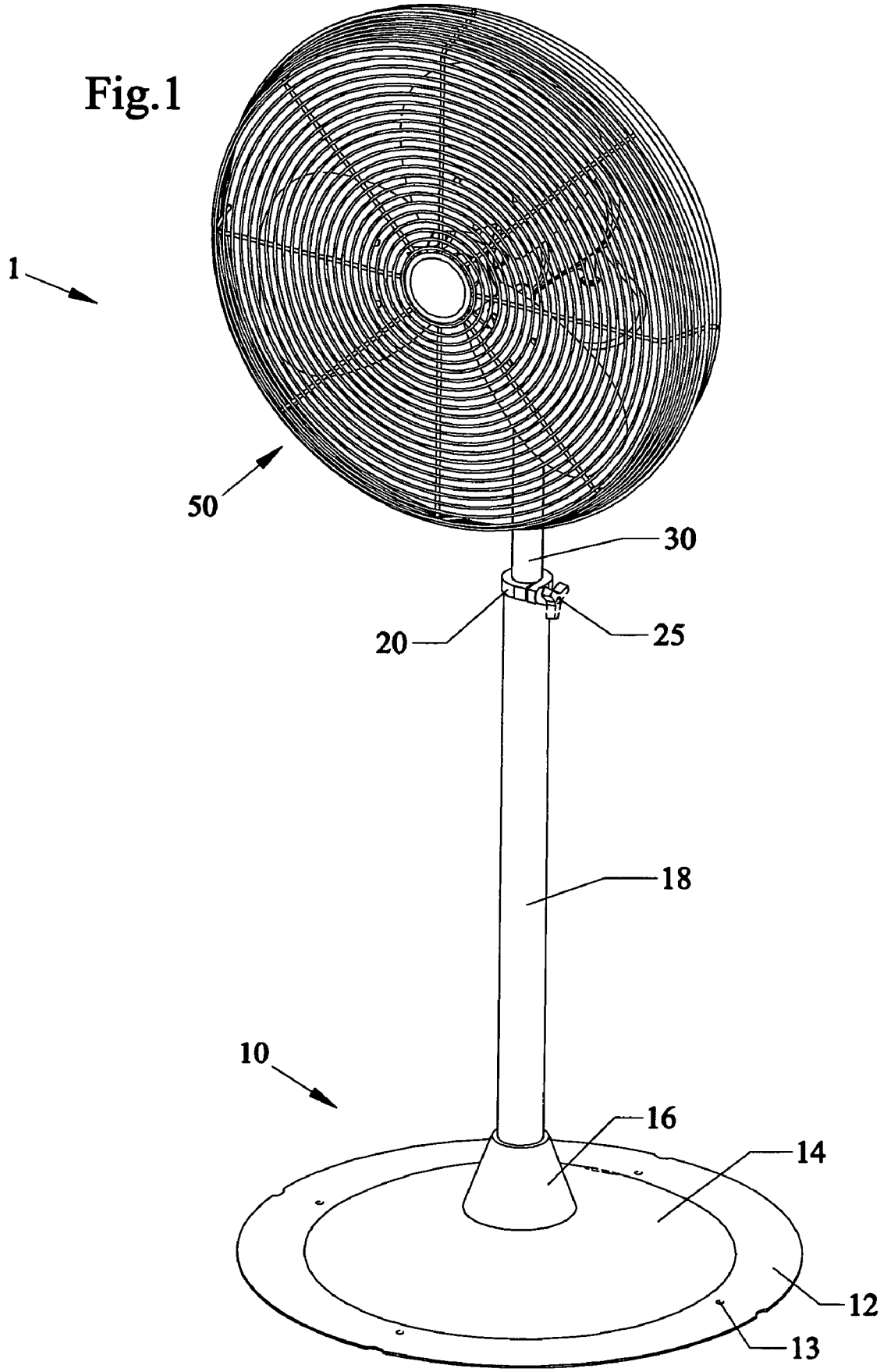
FIG. 1 is a front perspective view of a pedestal fan version of the invention.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of the components will now be described.

1 Pedestal Fan Embodiment
10 Base
12 Flat outer base ring
13. Fastener holes to mount base
14 middle domed base portion
16 cone base connector
18 lower tubular support
20 upper end of lower tubular support
25 rotatable tightening knob with internal protruding member To lock telescoping upper and lower tubular supports
30 upper tubular support
31 elongated oval opening for pivoting knob 35 in flat flange 32
32 flat flange connector on upper tubular support
33 through-holes for fasteners
35 pivoting position tightening knob
36 elongated oval through-hole for pivoting knob
37 fastener for pivoting knob
38 parallel flange plates
39 through-hole for pivoting fastener
50 grill cage for fan blades
52 grill section for mounting to motor housing 100
54 outer grill section
60 fan blades
100 water resistant motor housing
101 Hex nut
102 spring washer
103 front end plate
104 rubber ring
105 bearing
106 open ring
107 Rotor
107P Axle pin on rotor
108 stator
109 cylindrical motor housing shell
110 open ring
111 bearing
112 wavy washer
113 rear endplate
114 hex head bolt
115 gear box
116 capacitor
117 washer
118 screw
119 washer
120 screw
121 cord clip
122 clam shell
123 screw
124 spring washer
125 elbow
126 pull chain
127 oscillating knob
128 screw

Figure 2:
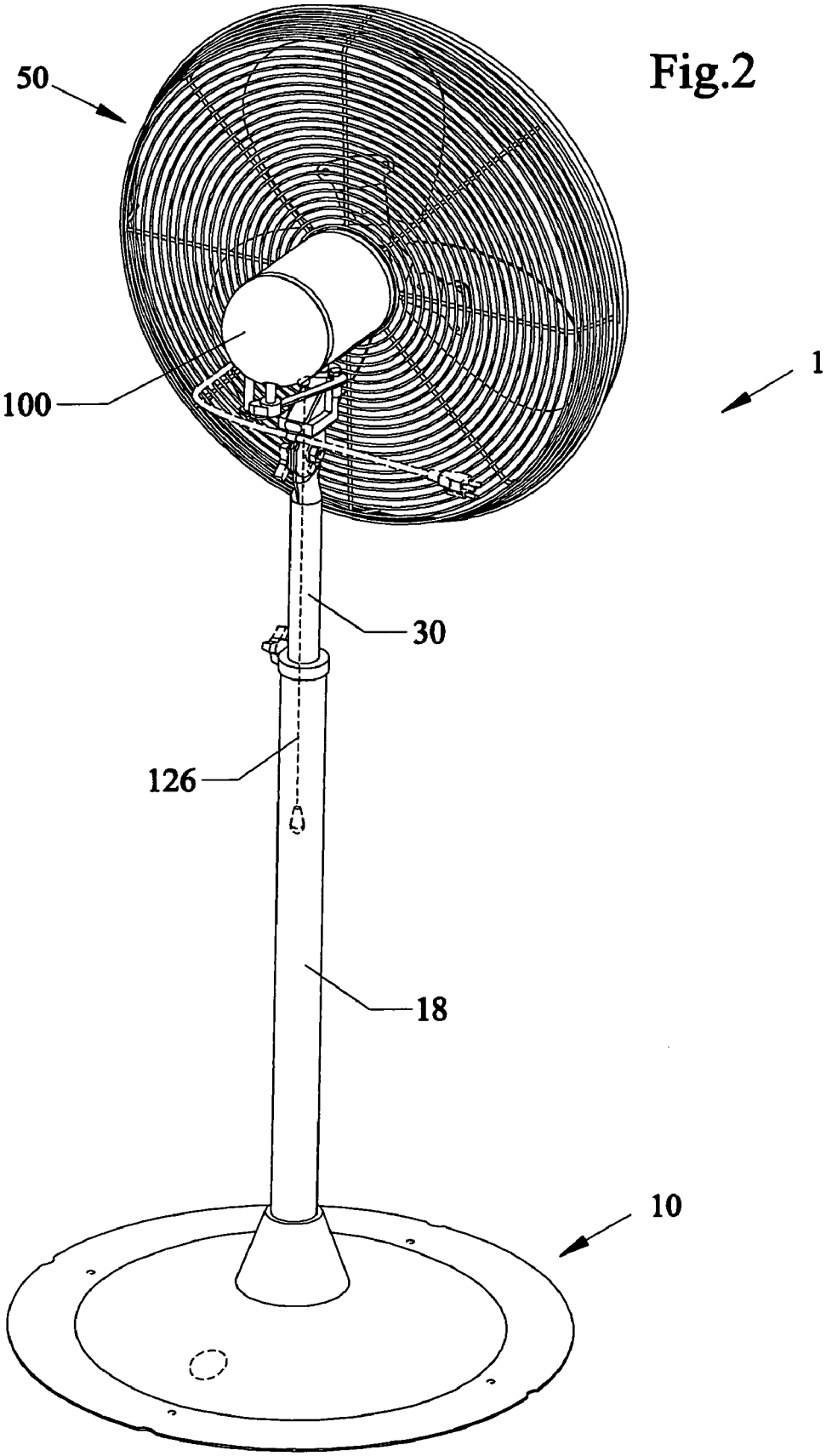
FIG. 2 is a rear perspective view of the pedestal fan of FIG. 1.
Figure 3:
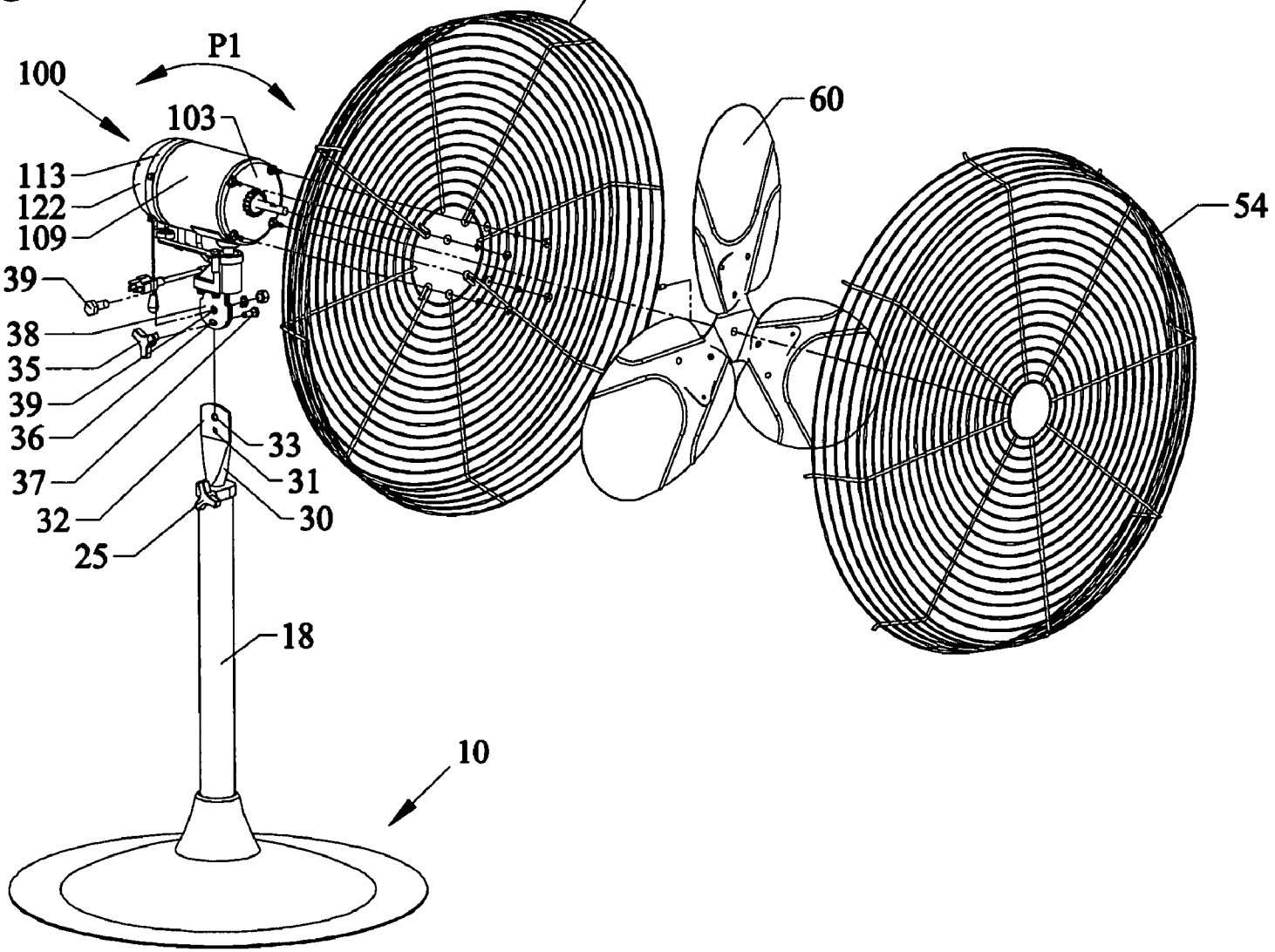
FIG. 3 is an exploded view of the pedestal fan of FIG. 1.
Figure 4:
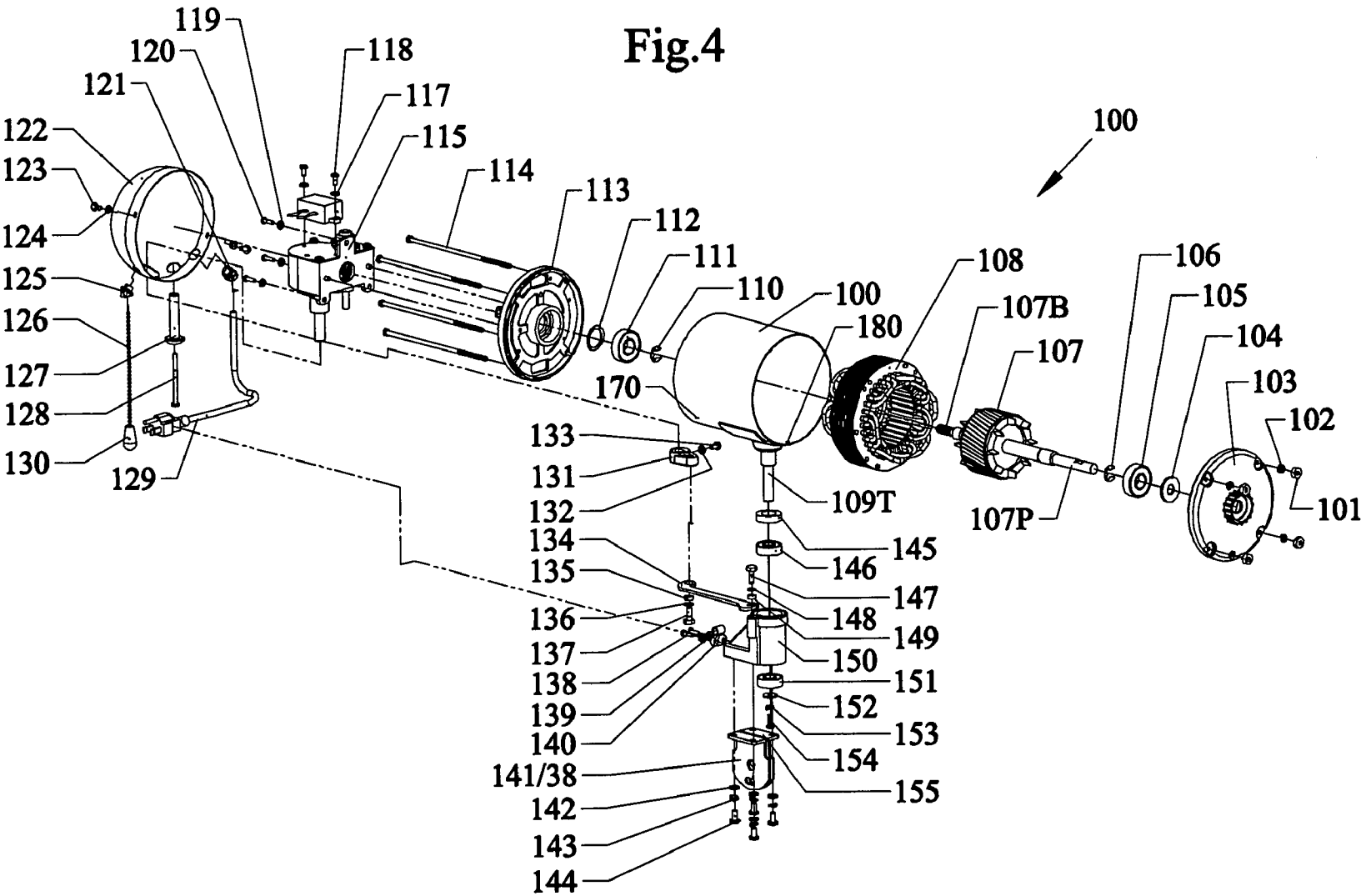
FIG. 4 is an exploded view of the motor housing of the pedestal fan of FIGS. 1-3.
Figure 5:
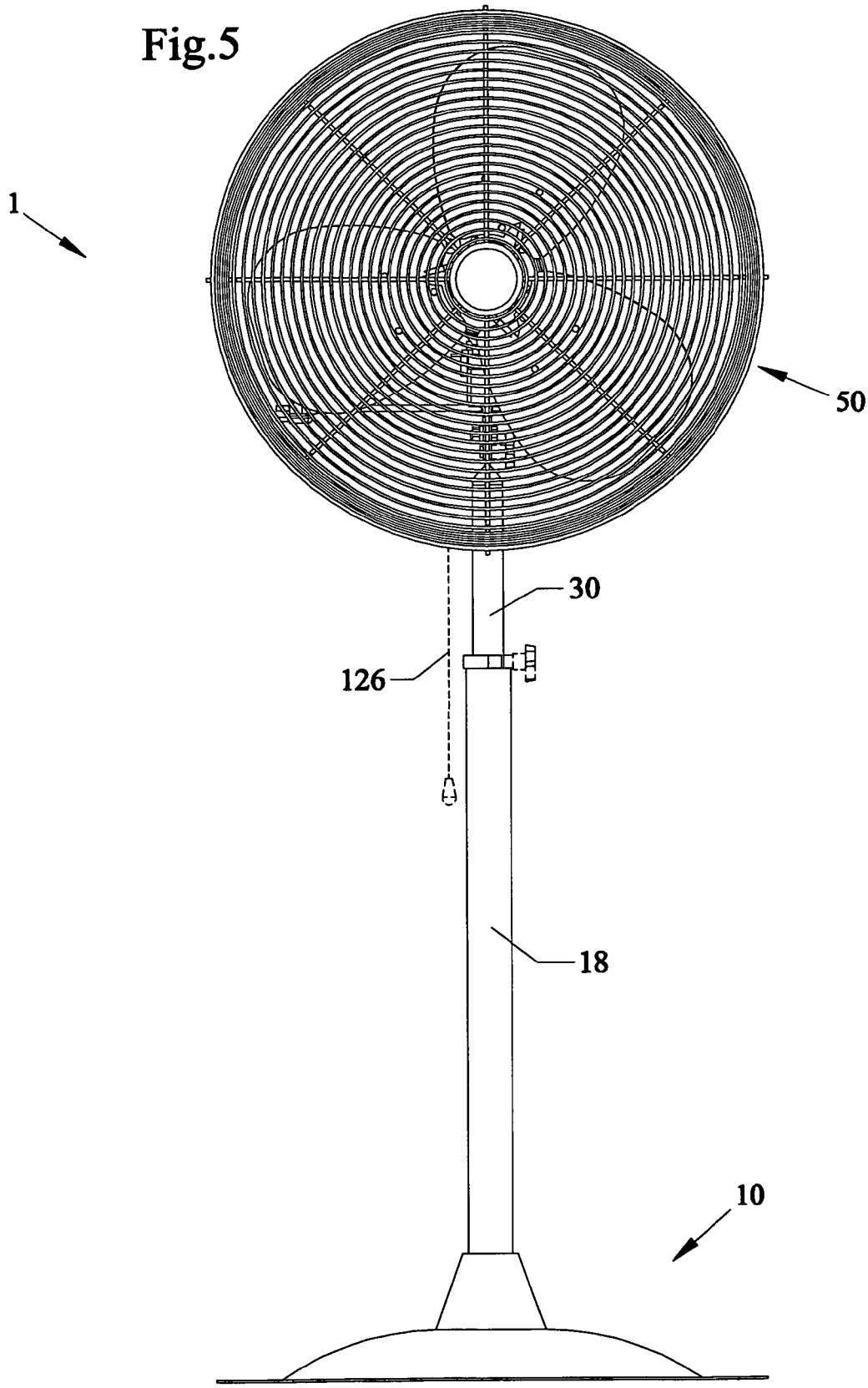
FIG. 5 is a front planar view of the pedestal fan of FIG. 1.
Figure 6:
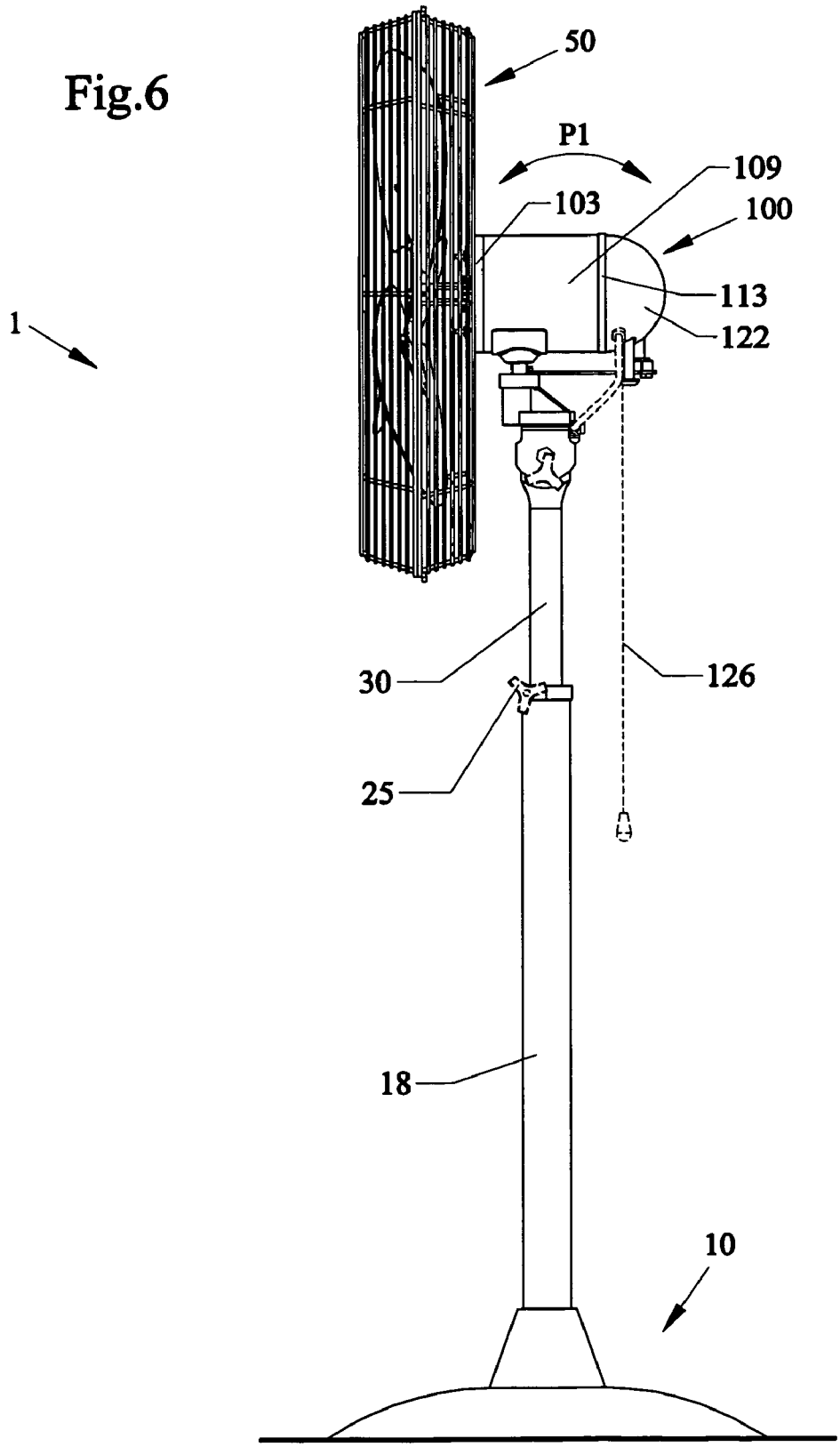
FIG. 6 is a right side view of the pedestal fan of FIG. 1.
Figure 7:
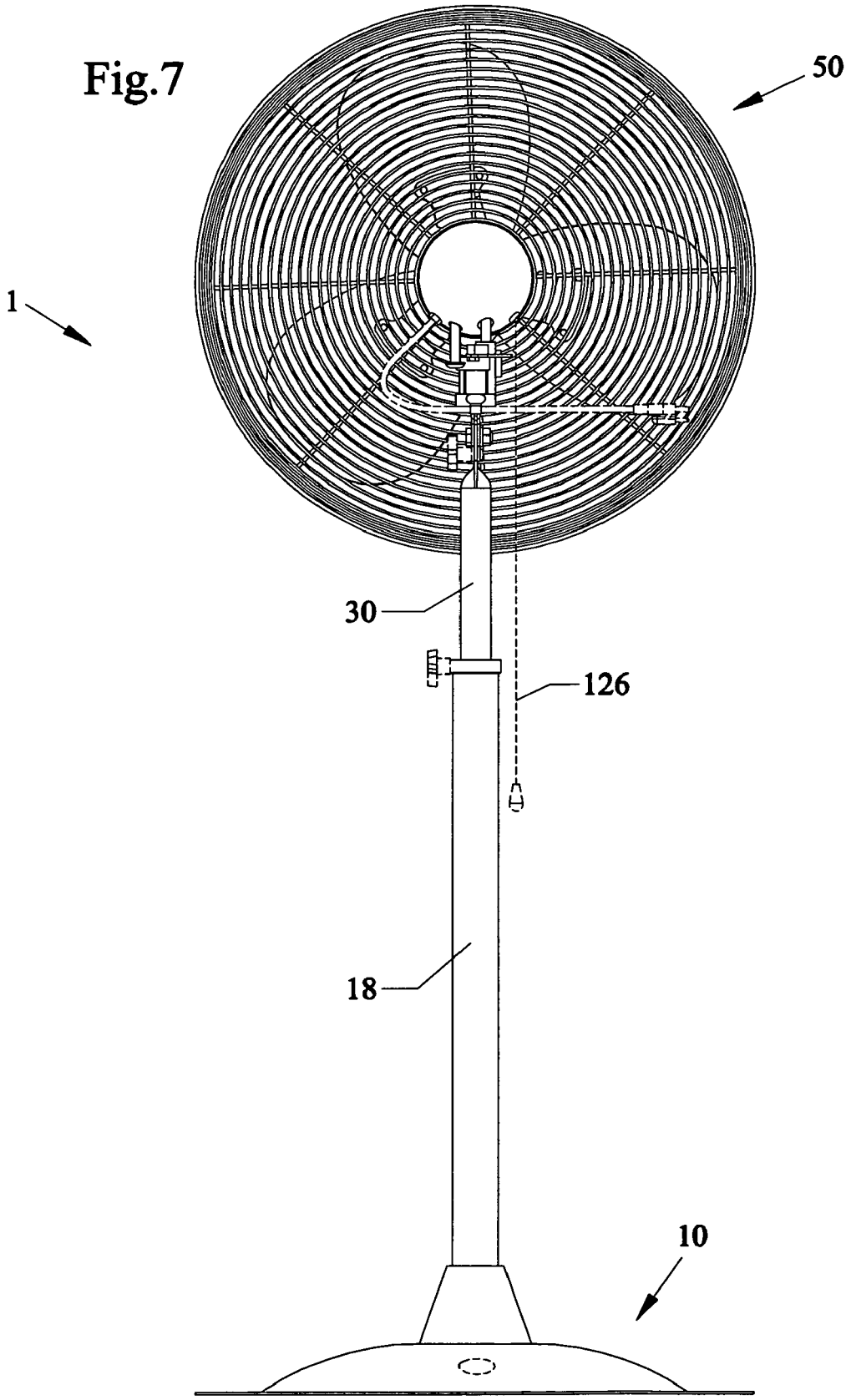
FIG. 7 is a rear view of the pedestal fan of FIG. 1.
Figure 8:
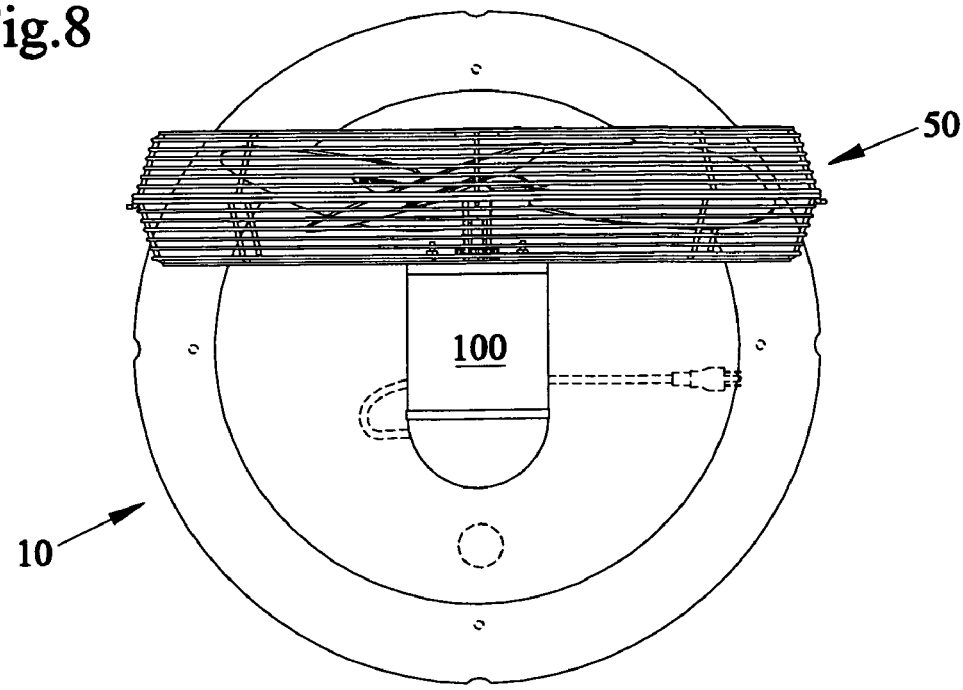
FIG. 8 is a top view of the pedestal fan of FIG. 1.
Figure 9:
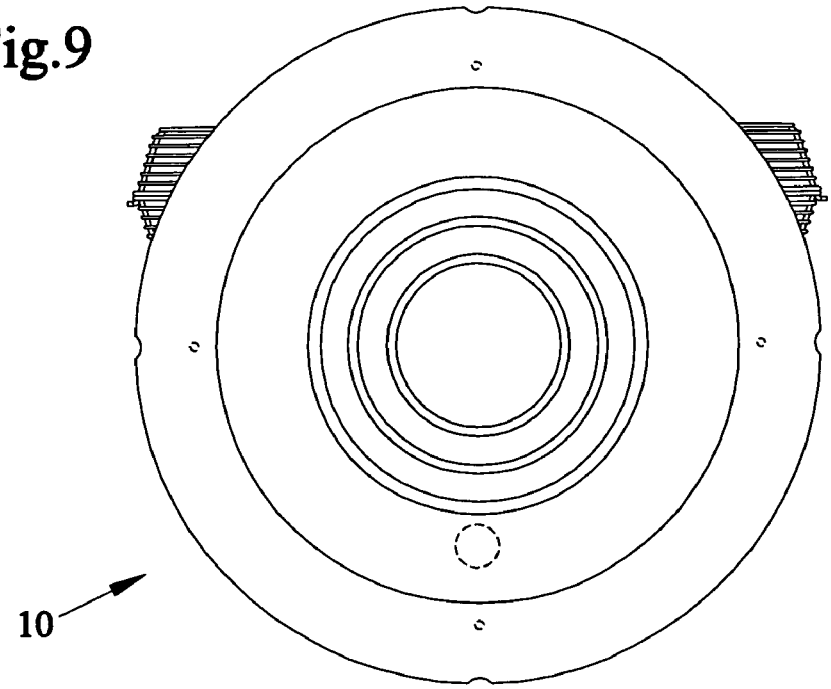
FIG. 9 is a bottom view of the pedestal fan of FIG. 1.

129 power cord
130 fob
131 driver
132 washer
133 screw
134 linkage
135 washer
136 washer
137 screw
138 screw
139 spring washer
140 cord clip
141 flag (parallel plates
142 washer
143 spring washer
144 screw
145 seal gasket
146 bearing
147 screw
148 washer
149 washer
150 bearing seat
151 bearing
152 washer
153 spring washer
154 screw
155 connecting plate for parallel flange plates 38/flag 141
200 Wall Mounted Fan Embodiment
210 Wall connecting base plate
213. Fasteners and mounting holes to mount base
214 mounting sleeve on base plate
215 upper opening in mounting sleeve
217 tightening knob to lock lower end 222 of mounting arm 220 to base plate
220 Step shaped mounting arm
222 lower end of mounting arm 220
228 upper end of mounting arm
232 flat flange connector on upper end of mounting arm
233 through-holes for fasteners
35 pivoting position tightening knob
36 through-hole for pivoting knob
37 fastener for pivoting knob
38 parallel flange plates
39 through-hole for pivoting fastener
250 grill cage for fan blades
252 grill section for mounting to motor housing 100
254 outer grill section
260 fan blades Pedestal Fan Embodiment FIG. 1 is a front perspective view of a pedestal fan version 1 of the invention. FIG. 2 is a rear perspective view of the pedestal fan 1 of FIG. 1. FIG. 3 is an exploded view of the pedestal fan 1 of FIG. 1. FIG. 4 is an exploded view of the motor housing 100 of the pedestal fan 1 of FIGS. 1-3. FIG. 5 is a front planar view of the pedestal fan 1 of FIG. 1. FIG. 6 is a right side view of the pedestal fan 1 of FIG. 1. FIG. 7 is a rear view of the pedestal fan 1 of FIG. 1. FIG. 8 is a top view of the pedestal fan 1 of FIG. 1. FIG. 9 is a bottom view of the pedestal fan 1 of FIG. 1.

Referring to FIGS. 1-9, pedestal fan 1 can include base 10 that can have a diameter of approximately 25 to approximately 28 inches, flat outer base ring 12 with fastener holes 13 that can mount the pedestal fan with fasteners, such as bolts and the like to other surfaces such as but not limited to concrete, pavement, wood decks, and the like. The base 10 can have a middle dome portion 14 with a cone shaped connector 16 which functions as a center piece to support lower tubular support 18, the latter of which can have a diameter of approximately 2 to approximately 3 inches, and have a height of approximately 30 to approximately 36 inches. An enlarged upper end 20 of the lower tubular support 18 can have a ring shape with a rotatable tightening knob 25 with an internal protruding member which can lock against side walls of an upper tubular member 30, that can have a diameter of approximately 1¾ to approximately 2¾ inches, the latter of which can also have an telescoping adjustable height of approximately 30 to 36 inches tall. The upper end of upper tubular support 30 can include a flat flange connector 32 with through-hole(s) 33 therethrough.

The motor housing 100 is attached to the flat flange 32 of the upper tubular support by parallel flange plates 38, the latter of which fit over and about flat flange 32. A knob 36 can fit into an elongated oval shaped through-hole 36 in the flange 32 and a like elongated oval shaped through-hole 31 in flat flange 32. A bolt fastener 39 with mateable fastener can attach though circular openings 33, 39 in both the parallel flange plates 38 and flat flange 32. The motor housing 100 with grill cage 50 can pivot about bolt fastener 39 that is within openings so that the grill cage 50 can be positioned to aim upward, horizontal or downward as desired. The knob 35 with fastener can be moved within elongated oval shaped through holes 31, 36, and then rotated to locking the position of the grill cage 40 in the different positions.

Referring to FIGS. 3, 4, 6 and 8, the motor housing 100 can have a rotor 107 positioned inside of a stator 108 which fits into a right end of a cylindrical motor housing shell 109. The front rotor pin 107P can pass through open ring 106, bearing 105 and rubber ring 104, and the front end of motor housing shell 109 can be covered by a front end plate 103 so that the end of front rotor pin 107P protrudes therefrom. Elongated hex head bolts 114 can attach the rear end plate 133 to the rear end of the motor housing shell 109 and also attach the front end plate 103 to the front end of the motor housing shell 109 with hex nuts 101 that can lock against spring washers 102 against the outer surface of the front end plate 103.

Rear rotor pin 107B can pass through open ring 110, bearing 111, wavy washer 112, and rear end of motor housing shell 109 can be capped by rear endplate 113 so that rear rotor pin 107B can protrude rearwardly from rear end plate 113 of motor housing shell 109. Rearwardly extending rear rotor pin 107B can pass into gear box 115 that can have a capacitor 116 mounted thereon by mounting screws 118 and washers 117. The gear box 115 can be mounted to the outside of rear end plate 113 by screws 119 and washers 118. Capping the outside of rear end plate 113 can be a dome shaped clam shell 122 that can be held in place by screw 137 with threaded shaft passing through washers 135, 136 one end of linkage 134, driver 131 which is attached through an opening underneath clam shell 122 and into the bottom protruding tip of gear box 115. A driver 131 spaces the end of linkage 134 to be spaced below the clam shell 122. The driver 131 can be held in place by an outer screw 133 that attaches with a washer to abut against the downwardly protruding tip of gear box 115.

In the novel invention, the gear clutch components were redesigned from a normal position on the top of a fan motor to the unique new location of underneath to provide wet proof operation. The linkage 134 was developed to be corrosive resistant under the motor housing 109 and the oscillating knob 127 is located downward to prevent water intrusion from rain.

The motor housing 100 is kept oriented relative to the tubular support stand components 18, 30 by the linkage 134.

A downwardly protruding support rod 109T that is fixably attached to the lower surface of the motor housing shell 109 passes through seal gasket 145, bearing 146 and into an upper opening in bearing seat 150. An upwardly protruding screw 154 with spring washer 153 and washer 154 attaches a lower bearing 151 to the bottom of protruding support rod 109T An inner end of linkage 134 attaches to an upper end edge of bearing seat 150 by a screw 147 with washers 148, 149. An oscillating knob 127 has an upper end that fits into a small through-hole in the bottom of the clam shell 122 and into the gear box 115.

The pull down and push up oscillating knob 127 can have two positions, one that keeps the fan in fixed orientation, and another pulled down position that allows the fan to oscillate (rotate in a horizontal plane) that is perpendicular to the support state members 18, 30.

The gear mechanism has been designed to give long life operation at big torques on the gear. The gear box 115 has been constructed with steel and brass since the oscillating feature created higher than normal wear and tear on all the parts and gears in the gear box 115. This construction allows for the parts to not break and wear out over normal operating conditions.

The oscillating switch and mechanism are places on the underside of a completely sealed motor to prevent water from entering the motor.

The invention can use a large ¼ hp motor instead of the ⅛ hp motor that has been used on prior art type fans. Low, medium and high speed amps are approximately 1.58, approximately 1.68 and approximately 1.91 amps respectfully. The watts for the ⅛ hp motor for low, medium and high speeds are approximately 134, approximately 200 and approximately 295 watts respectfully.

The motor can be built with more steel and copper to dissipate the heat since it is a totally enclosed drip proof system.

A power activation switch for the novel fan 1 can be done by a pull chain 126 that is mounted through a small through-hole in the bottom of the clam shell 122 having an elbow 125 mounted therein. The pull chain is drip proof and will not allow water inside like most rotary switches.

The switch can use copper parts inside to minimize corrosion and the pull chain 126 goes through a drip proof pull chain elbow 125 to prevent rain or hose spray from entering the unit. The chain pull 126 can be a stainless steel chain to prevent corrosion. The bottom of the pull chain 126 can have a fob 130 that can be easily handled by an operator, and the upper end of the chain 126 can connect into the gear box 115. Pulling down on the pull chain 126 by the fob 130 can turn the fan on, pulling down a second time can switch the fan into a slow rotational speed while pulling another time can go to a higher operating speed or turn off the fan.

Electrical power can be supplied to the fan by a power cord 129 having an upper end that passes through a sealable cord clip 121 that is in a small opening in the bottom of shell casing 122.

The plug and SJT wire is sealed at the housing and clamped to the oscillating ball bearing bracket to prevent fatigue in the wire during oscillations.

The plug cord 129 with three SJT (Service Junior Thermoplastic) wire construction attaches to the Bearing sleeve 150 with a cord clip 140 and spring washer 139 to provide enough flex in the power cord 129 to prevent failure after approximately 100,000 plus hours of operation. This arrangement of components is substantially different conventional units which have the power cord down directly, which leads to pinched cord that could cause the power cord to fail quickly.

Optional front small drainage hole 180 and/or optional rear small drainage hole 170 can be located adjacent to the front end and/or rear end of the motor housing shell so that any excess moisture inside the motor housing can safely drain away from the motor.

The motor housing 100 is attached to the flag 141 (parallel flange plates 38) by screws 144, spring washers 143 and washers 142 that attach a connecting plate 155 to the bottom of the bearing seat 150. The motor housing 100 attaches to the tubular support members 30 and 18 as previously described.

All of the exterior components such as the motor housing 100 and pedestal stand components 10, 18 and 30 as well as the interior components of the motor housing and grill and fan blades can be formed from stainless steel and the like.

These components can further have a powder coat finish to reduce corrosion, and other damage that can be caused by hot, cold, wet and dry environmental conditions.

We developed a 3_M coating that is a very durable paint system well advanced over the durable powder coat systems used in the industry. The metal parts can be pre-coated using a special technique to allow the heavy duty powder coat to stick permanently without leaving any holes or exposed edges that could lead to corrosion of the steel parts.

Referring to FIGS. 3-4, front rotor pin 107P can be connected to the middle hub portion of three form blades 60, and held in place by fasteners such as nuts, and the like. Blades 60 can be pre-formed blades formed from metal such as but not limited to aluminum, galvanized metal, and the like, and preferably be one piece. The blades 60 can have diameters of approximately 24 inches across, and 30 inches across as well as smaller and larger sizes as needed and can be housed in a grill cage 50 that has a rear grill section 52 that can be mounted to the front plate 103 by conventional fasteners such as screws, washers and nuts, and the like. An outer grill section 54 can snapably attach to the rear grill section and cover the blades 60 therein.

Wall Mounted Fan Embodiment

Figure 10:
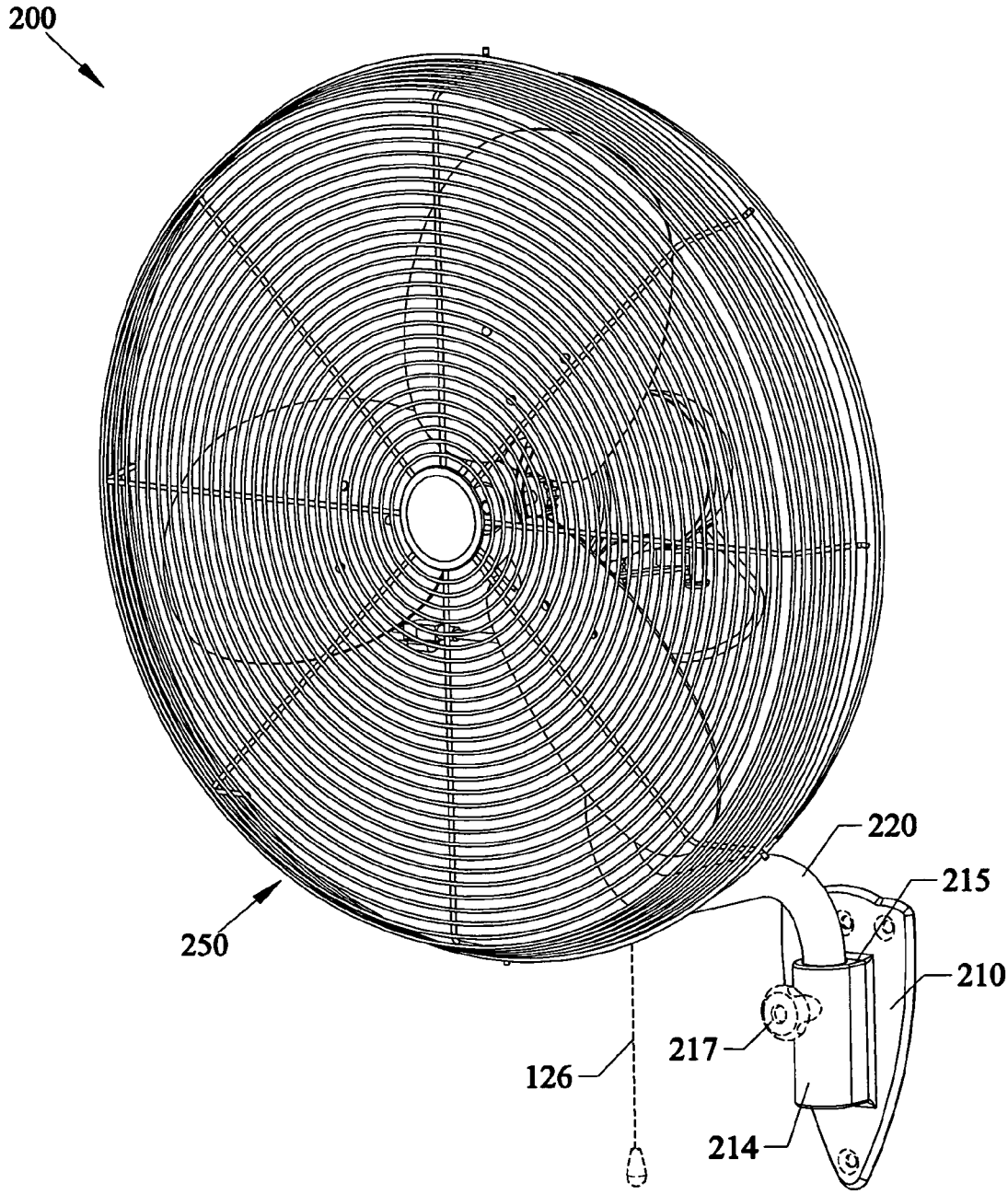
FIG. 10 is a front perspective view of a wall mounted fan version of the invention.
Figure 11:
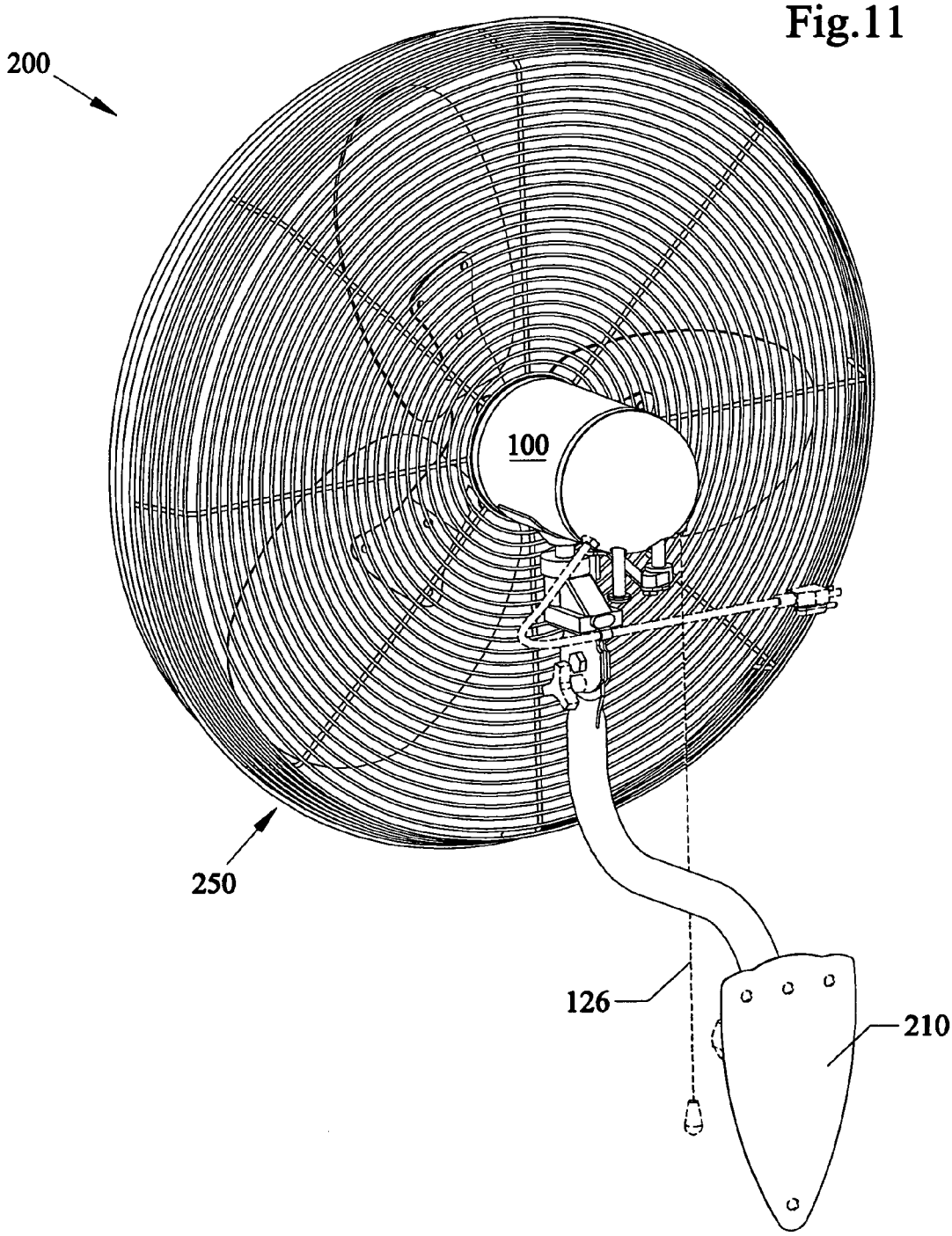
FIG. 11 is a rear perspective view of the wall mounted fan of FIG. 10.
Figure 12:
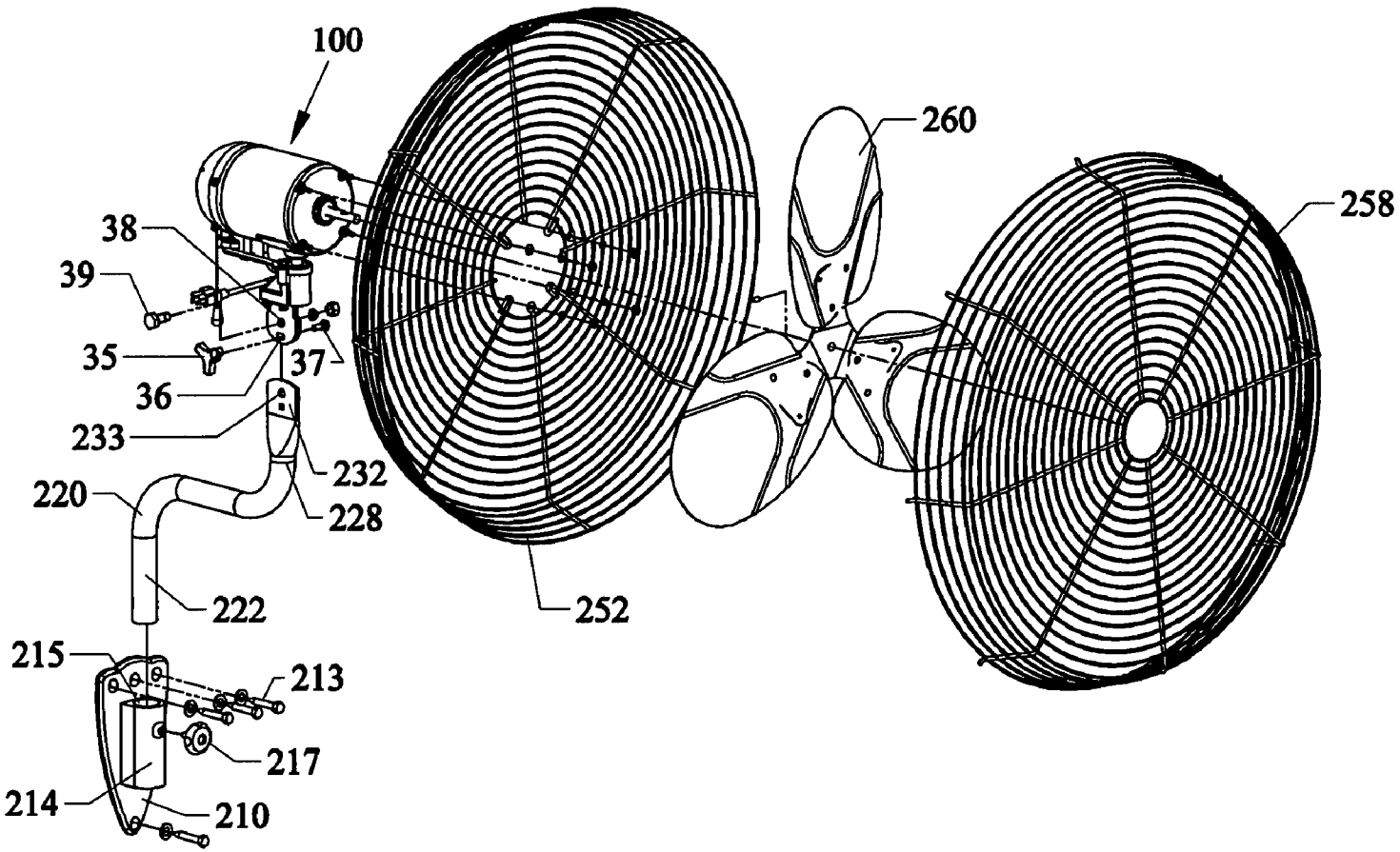
FIG. 12 is an exploded view of the wall mounted fan of FIG. 10.
Figure 13:
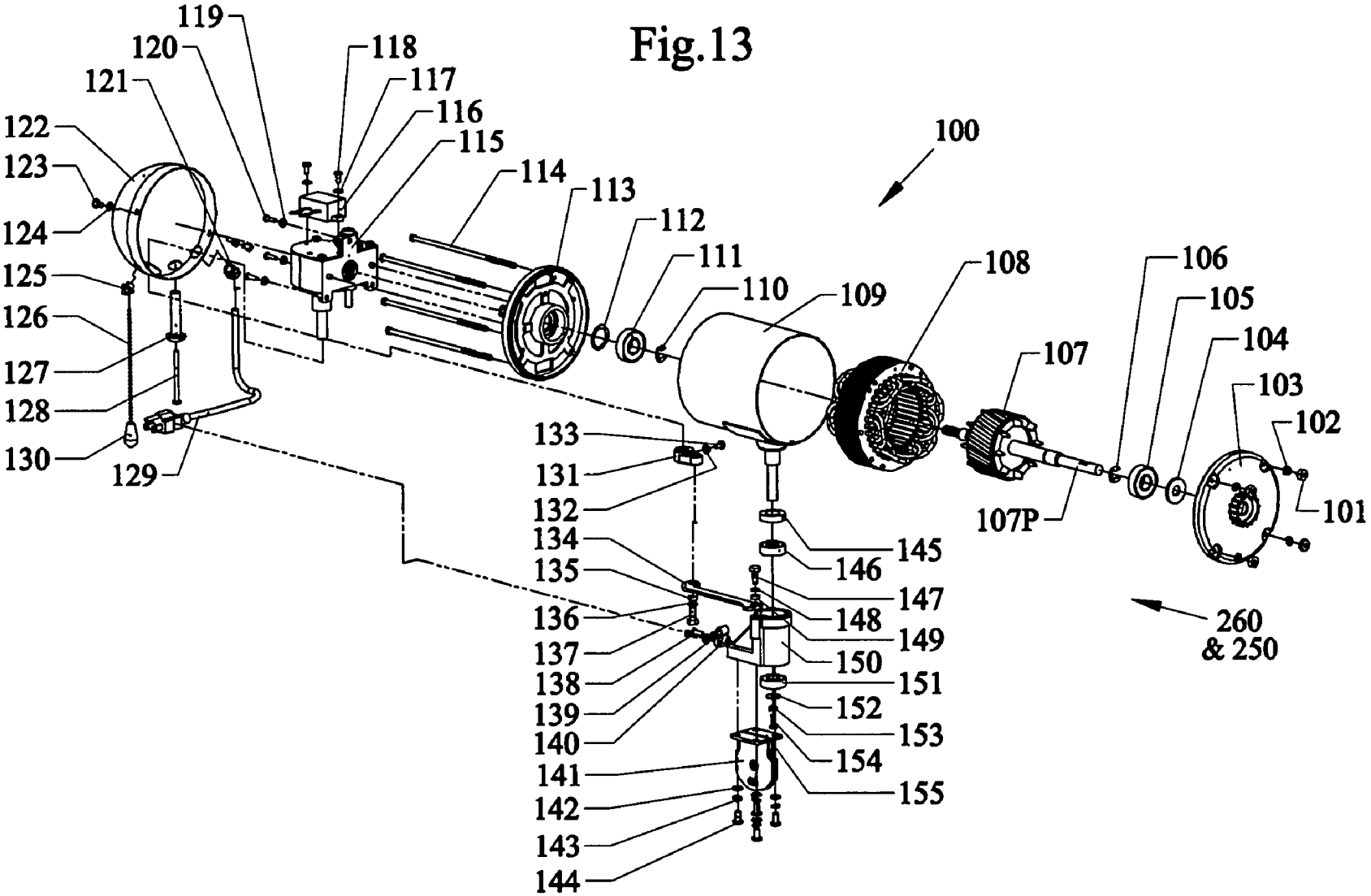
FIG. 13 is an exploded view of the motor housing of the fan of FIGS. 10-12.
Figure 14:
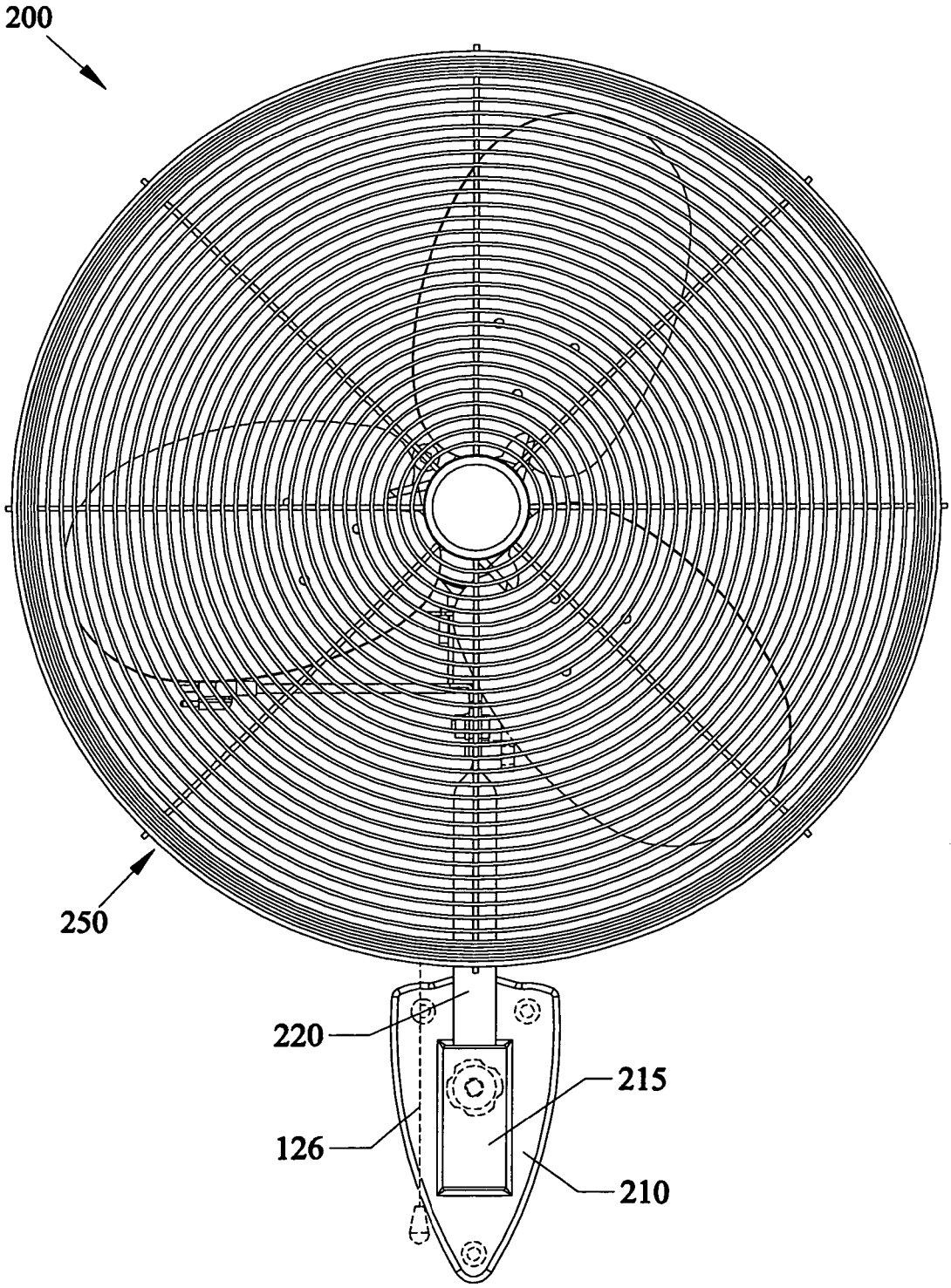
FIG. 14 is a front planar view of the wall mounted fan of FIG. 10.
Figure 15:
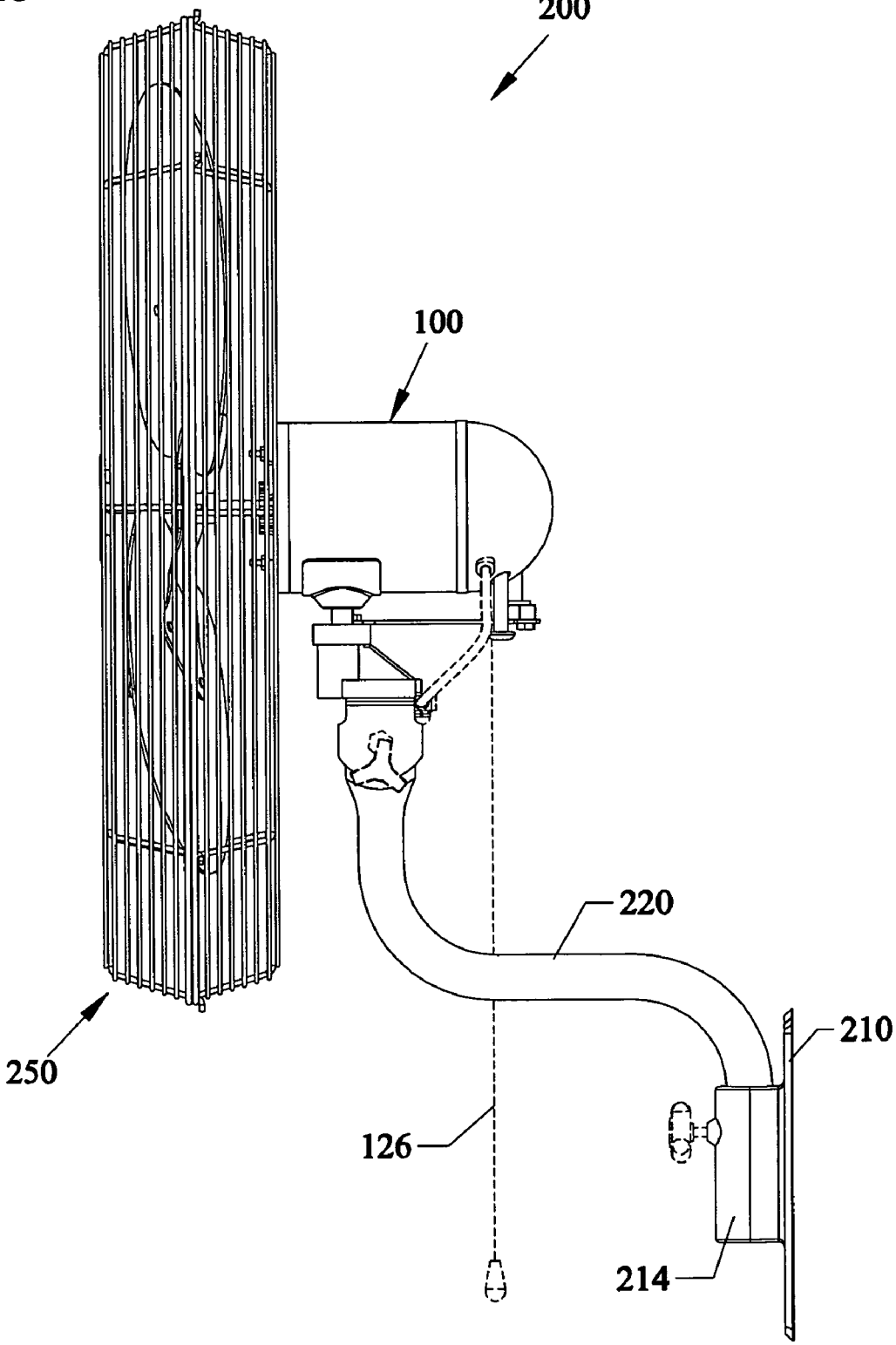
FIG. 15 is a right side view of the wall mounted fan of FIG. 10
Figure 16:
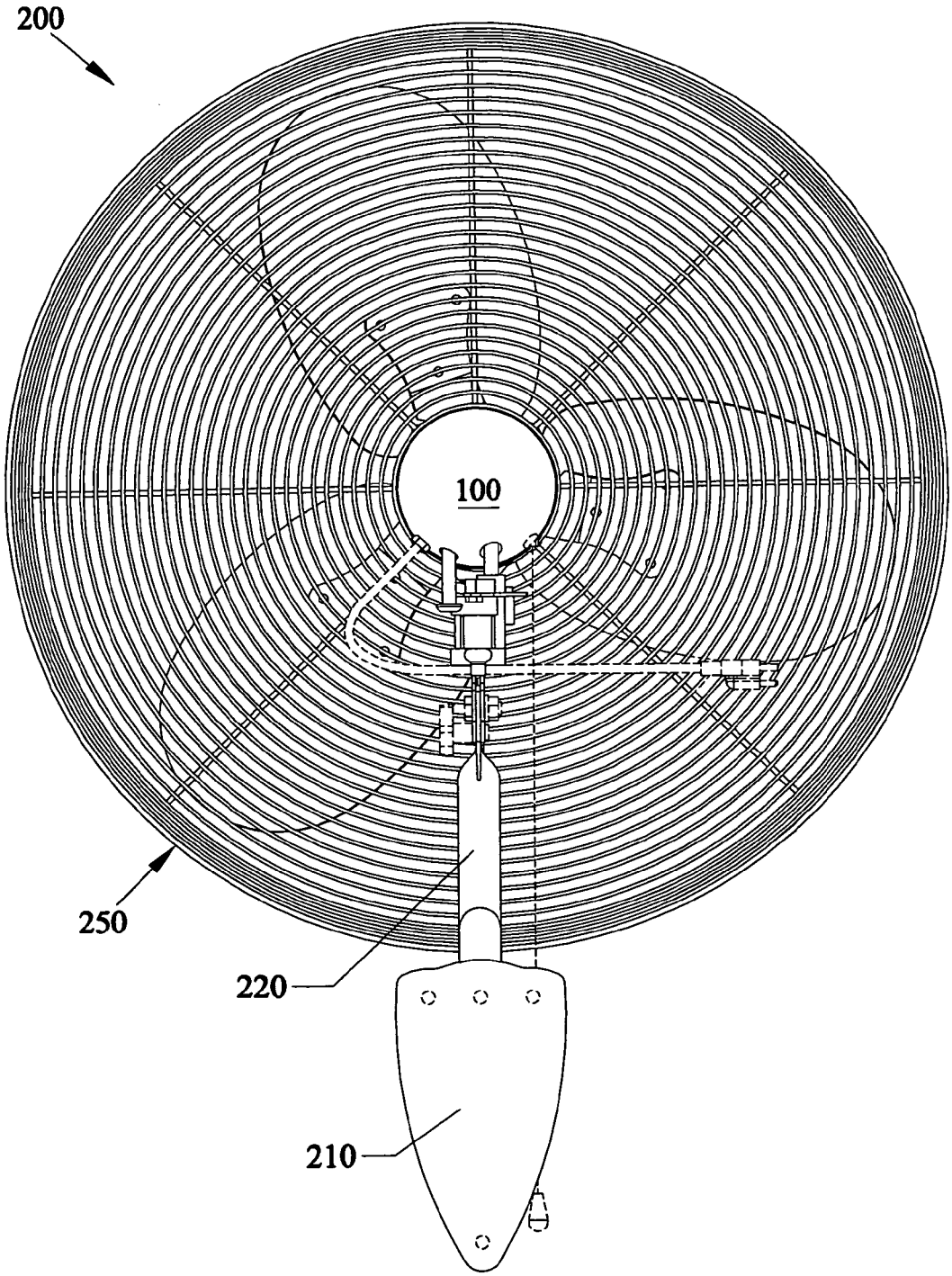
FIG. 16 is a rear view of the wall mounted fan of FIG. 10.
Figure 17:
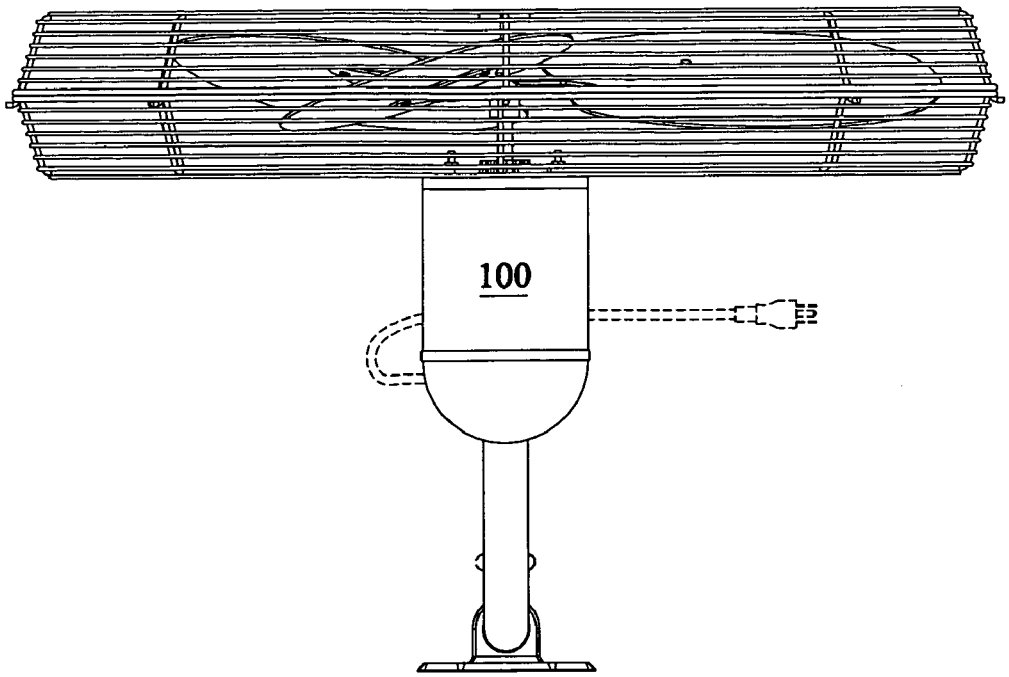
FIG. 17 is a top view of the wall mounted fan of FIG. 10.
Figure 18:
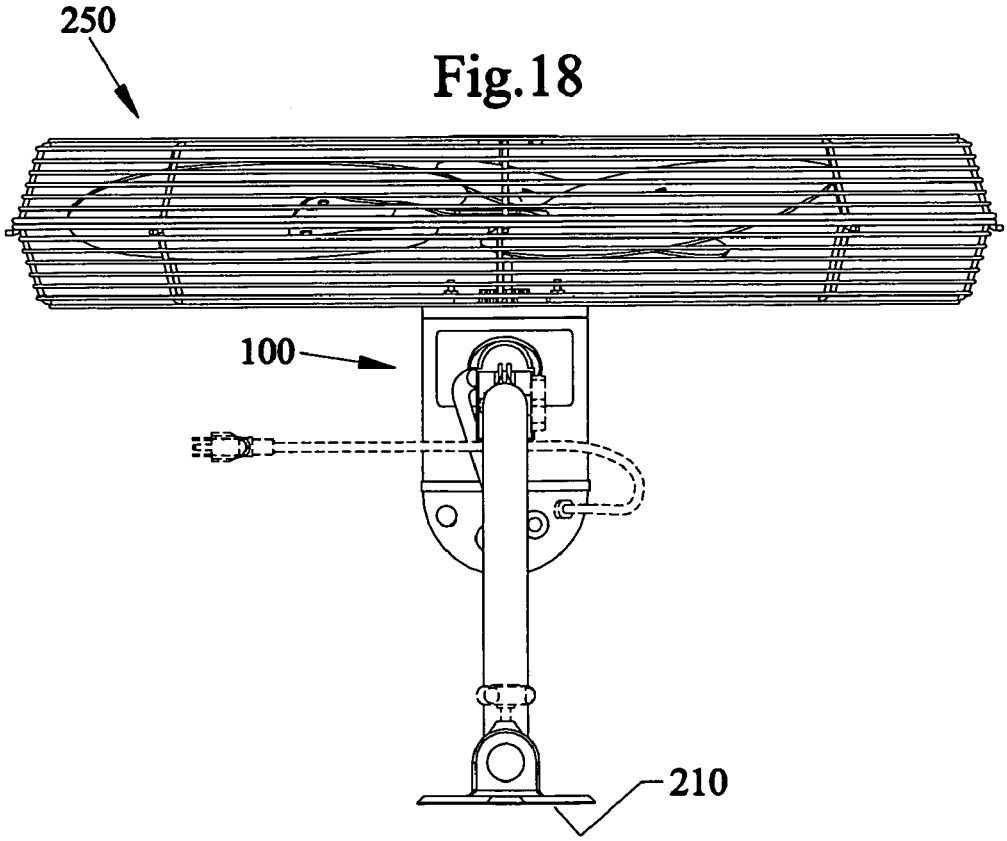
FIG. 18 is a bottom view of the wall mounted fan of FIG. 10.

FIG. 10 is a front perspective view of a wall mounted fan version 200 of the invention. FIG. 11 is a rear perspective view of the wall mounted fan 200 of FIG. 10. FIG. 12 is an exploded view of the wall mounted fan 200 of FIG. 10. FIG. 13 is an exploded view of the motor housing 100 of the fan 200 of FIGS. 10-12. FIG. 14 is a front planar view of the wall mounted fan 200 of FIG. 10. FIG. 15 is a right side view of the wall mounted fan 200 of FIG. 10 FIG. 16 is a rear view of the wall mounted fan 200 of FIG. 10. FIG. 17 is a top view of the wall mounted fan 200 of FIG. 10. FIG. 18 is a bottom view of the wall mounted fan 200 of FIG. 10.

Referring to FIGS. 10-18, the wall mounted fan 200 can include a wall connecting base plate 210 that can have a triangular configuration with through-holes 213 that can be used for conventional fasteners such as screws and washers to attach the fan 200 to an outdoor wall on a building, structure, and the like. On the front of the base plate 210 can be a vertically oriented sleeve 214 having an opening 215 in an upper end for allowing the lower end 222 of a step shaped arm 220 to fit into. The step shaped arm can be pipe shaped and can have a length of approximately 1 to approximately 2 feet, and have a diameter of approximately 1 to approximately 2 inches. The lower end 222 of arm 220 can be cylindrical in order to allow for some rotation within socket opening 215. A rotatable knob 217 having an inner protruding portion can abut against the sides of end 222 to lock the position of the step shaped arm 2220 relative to the wall connected base plate 210.

Referring to FIG. 12 and FIG. 3 of the previous embodiment, the upper end 228 of step shaped support arm 220 can be attached to a flat flange connector 232 with through-hole (s) 233 therethrough. The motor housing 100 is attached to the flat flange 232 of the upper tubular support by parallel flange plates 38, the latter of which fit over and about flat flange 32 which is described in more detail in reference to the pedestal mounted fan described above.

As described in the previous embodiment, the knob 36 can fit into an elongated oval shaped through-hole 36 in the flange 32 and a like elongated oval shaped through-hole 31 in flat flange 32. A bolt fastener 39 with mateable fastener can attach though circular openings 33, 39 in both the parallel flange plates 38 and flat flange 32. The motor housing 100 with grill cage 50 can pivot about bolt fastener 39 that is within openings so that the grill cage 50 can be positioned to aim upward, horizontal or downward as desired. The knob 35 with fastener can be moved within elongated oval shaped through holes 31, 36, and then rotated to locking the position of the grill cage 40 in the different positions.

FIG. 13 describes the motor housing 100 and can use the same components that are described in reference to the motor housing 100 shown in FIG. 4.

Referring to FIGS. 12-18, front rotor pin 107P can be connected to the middle hub portion of three form blades 260, and held in place by fasteners such as nuts, and the like. Blades 260 can be pre-formed blades formed from metal such as but not limited to aluminum, galvanized metal, and the like, and preferably be one piece. The blades 60 can have diameters of approximately 24 inches across, and 30 inches across as well as smaller and larger sizes as needed and can be housed in a grill cage 250 that has a rear grill section 252 that can be mounted to the front plate 103 by conventional fasteners such as screws, washers and nuts, and the like. An outer grill section 254 can snapably attach to the rear grill section and cover the blades 260 therein.

Although the preferred embodiments describe applications for using the novel motor housing and related components in a pedestal fan and a wall mounted fan, the invention can be used in other applications, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A high velocity fan for outdoor use, comprising:

a plurality of blades having inner blade ends about a middle hub, and outer blade tips spaced away from the inner blade ends, the blades having front sides and rear sides, the plurality of the blades having a diameter between the outer blade tips;

a front grill section for protecting the front sides of the plurality of the blades;

a rear grill section for protecting the rear sides of the plurality of the blades, wherein outer perimeter edges of the front grill section are attached to outer perimeter edges of the rear grill section;

a rotor pin having a front end attached to the middle hub of the plurality of the blades, and a rear end;

an electric motor supplied by electric power, for rotating the rear end of the rotor pin in order to rotate the plurality of the blades; and a waterproof cylindrical housing having a front open end and a rear open end and closed cylindrical side walls between the front open end and the rear open end, the cylindrical housing wrapped about the motor for preventing moisture infiltration to the motor therein, the cylindrical housing being waterproof with no exterior vents through side walls the cylindrical housing, the cylindrical housing having a diameter substantially smaller than the diameter between the outer blade tips of the plurality of the blades;

a front plate for closing off the front open end of the cylindrical housing, and having a single opening for allowing the front end of the rotor pin to protrude therefrom;

a rear plate for closing off the rear open end of the cylindrical housing, and having a single opening for allowing the rear end of the rotor pin to protrude therefrom;

a tilt and rotate mount attached to a support for tilting and rotating the fan, the mount being attached underneath the cylindrical side walls of the cylindrical housing, the mount for allowing the cylindrical housing to tilt up and down and rotate relative to the support, the support being selected from one of a wall mounted arm and a pedestal stand;

a gear control for controlling the tilting and rotating of the fan, the gear control having a rotor portion being attached to the protruding rear end of the rotor pin outside of the cylindrical housing;

a linkage arm located underneath the cylindrical housing, the linkage arm attaching the Rear control to the tilt and rotate mount; and a rear shell for protectively covering the gear member, the rear shell being attached to the rear open end of the cylindrical housing.

2. The high velocity fan of claim 1, the rear shell further comprising:

a small opening underneath of the rear shell for allowing an electrical power wire to pass therethrough.

3. The high velocity fan of claim 1, the rear shell further comprising:

at least one drainage opening underneath of the rear shell.

4. The high velocity fan of claim 1, further comprising:

a power activation switch for the fan; and a mount for mounting the control switch underneath the rear shell.

5. The high velocity fan of claim 1, further comprising:

a pull chain for controlling the fan; and a mount for mounting the pull chain underneath the rear shell.

6. The high velocity fan of claim 1, the cylindrical housing further comprising:

a stainless steel cylindrical shell.

7. The high velocity fan of claim 1, the cylindrical housing further comprising:

a powder coat finish on the cylindrical housing.

8. The high velocity fan of claim 1, the motor further includes:

an inverted outdoor rated ¼ horse power oscillating motor.

9. The high velocity fan of claim 1, further comprising:

a front O-ring for forming a waterproof seal between the single opening in the front plate and the front end of the rotor pin that passes through the single opening through the front plate; and a rear O-ring for forming a waterproof seal between the single opening in the rear plate and the rear end of the rotor pin, the front O-ring and the rear O-ring further restricting water penetration into the cylindrical housing.

10. The high velocity fan of claim 9, further comprising:

a power cord having an inner end attached through the rear shell.

11. A high velocity fan for outdoor use, comprising:

a plurality of blades having inner blade ends about a middle hub, and outer blade tips spaced away from the inner blade ends, the blades having front sides and rear sides, the plurality of the blades having a diameter between the outer blade tips;

a front grill section for protecting the front sides of the plurality of the blades;

a rear grill section for protecting the rear sides of the plurality of the blades, wherein outer perimeter edges of the front grill section are attached to outer perimeter edges of the rear grill section;

a rotor pin having a front end attached to the middle hub of the plurality of the blades, and a rear end;

an electric motor supplied by electric power, for rotating the rear end of the rotor pin in order to rotate the plurality of the blades; and a waterproof cylindrical housing having a front open end and a rear open end and closed cylindrical side walls between the front open end and the rear open end, the cylindrical housing wrapped about the motor for preventing moisture infiltration to the motor therein, the cylindrical housing being waterproof with no exterior vents through side walls the cylindrical housing, the cylindrical housing having a diameter substantially smaller than the diameter between the outer blade tips of the plurality of the blades;

a front plate for closing off the front open end of the cylindrical housing, and having a single opening for allowing the front end of the rotor pin to protrude therefrom;

a rear plate for closing off the rear open end of the cylindrical housing, and having a single opening for allowing the rear end of the rotor pin to protrude therefrom;

a tilt and rotate mount attached to a support for tilting and rotating the fan, the mount being attached underneath the cylindrical side walls of the cylindrical housing, the mount for allowing the cylindrical housing to tilt up and down and rotate relative to the support, the support being selected from one of a wall mounted arm and a pedestal stand;

a gear control for controlling the tilting and rotating of the fan, the gear control having a rotor portion being attached to the protruding rear end of the rotor pin outside of the cylindrical housing;

a linkage arm located beneath the cylindrical housing for attaching the gear control to the tilt and rotate mount; and a rear shell for protectively covering the gear member, the rear shell being attached to the rear open end of the cylindrical housing;

a small opening underneath of the rear shell for allowing an electrical power wire to pass therethrough;

a switch for the fan mounted underneath the rear shell; and at least one drainage opening underneath of the rear shell, the cylindrical housing being waterproof with no exterior vents through the housing.

12. The high velocity fan of claim 11, the switch further includes:

a pull chain for controlling the fan; and a mount for mounting the pull chain underneath the rear shell.

13. The high velocity fan of claim 11, the cylindrical housing further comprising:

a stainless steel shell.

14. The high velocity fan of claim 11, the cylindrical housing further comprising:

a powder coat finish on the housing.

15. The high velocity fan of claim 11, the motor further includes:

an inverted outdoor rated ¼ horse power oscillating motor.

16. The high velocity fan of claim 11, further comprising:

a front O-ring for forming a waterproof seal between the single opening in the front plate and the front end of the rotor pin that passes through the single opening through the front plate; and a rear O-ring for forming a waterproof seal between the single opening in the rear plate and the rear end of the rotor pin, the front O-ring and the rear O-ring further restricting water penetration into the cylindrical housing.

17. The high velocity fan of claim 16, further comprising:

a power cord having an inner end attached through the rear shell.

* * * * *